US005555778A

United States Patent [19]

Otters et al.

[11] Patent Number: 5,555,778

[45] Date of Patent: Sep. 17, 1996

[54] CAN OPENER FOR PULL TOP CANS

[76] Inventors: Timothy P. Otters, 11317 Miller Rd., Whittier, Calif. 90604; Mary J. Bolmgren, 10430 Palo Alto, Rancho Cucamonga, Calif. 91730

[21] Appl. No.: 285,075

[22] Filed: Aug. 3, 1994

[51] Int. Cl.[6] ..... B67B 7/16

[52] U.S. Cl. ..... 81/3.55; D8/40

[58] Field of Search ..... 81/3.07, 3.47, 81/3.55; D8/18, 40

[56] References Cited

U.S. PATENT DOCUMENTS

| | | | |
|---|---|---|---|
| D. 269,246 | 6/1983 | Kroeger | D8/40 X |
| 3,454,075 | 8/1969 | Henderson | 81/3.07 |
| 3,460,411 | 8/1969 | Dyer | 811/3.07 |
| 4,207,781 | 6/1980 | Greenwood . | |
| 4,241,626 | 12/1980 | Hall . | |
| 4,253,352 | 3/1981 | O'Neal . | |
| 4,287,794 | 9/1981 | Kubach et al. . | |
| 4,362,071 | 12/1982 | Coker . | |
| 4,466,313 | 8/1984 | Gardner . | |
| 4,524,646 | 6/1985 | Kimberlin, Jr. . | |
| 4,530,260 | 7/1985 | Holka . | |
| 4,563,919 | 1/1986 | Sellars . | |
| 4,745,829 | 5/1988 | VanHoutte et al. . | |
| 5,108,409 | 5/1991 | Bittel | 81/3.55 |
| 5,309,794 | 5/1994 | Kelly | 81/3.55 |
| 5,390,567 | 2/1995 | Martorell | 81/3.55 X |

FOREIGN PATENT DOCUMENTS

| | | | |
|---|---|---|---|
| 3517310 | 11/1986 | Germany | 81/3.55 |

*Primary Examiner*—James G. Smith
*Attorney, Agent, or Firm*—Natan Epstein

[57] ABSTRACT

An opener tool having a working end, a convexly curved underside portion and a handle. The working end is dimensioned for insertion under the ring portion of a pull tab without lifting the pull tab ring sufficiently to bread the seal of the can top. The tool further has a stop element for limiting insertion of the working end through the finger opening.

14 Claims, 3 Drawing Sheets

CAN OPENER FOR PULL TOP CANS

BACKGROUND OF THE INVENTION

1. Field of the Invention

This invention generally pertains to the field of can openers and more particularly concerns an opener for use with pull top type cans.

2. Background of the Invention

Many sealed cans used for packaging and preserving foods and other products have pull-tab type closures. Two classes of pull-tab can closures are commonly used. In the first type, usually employed for packaging solid or semisolid materials, a can top is crimped along the upper edge of the can wall to form an elevated rim relative to the upper surface of the can top. The seam between the can top and the elevated rim is weakened by a score line which fully circumscribes the can top just inside of the elevated rim. A pull-tab riveted to the can top has a ring portion and a nose end diametrically opposed to the ring portion about the rivet fastener. In an original sealed condition of the can the pull tab lies flat against the can top. The rivet serves as a fulcrum for the pull-tab; as the ring portion is lifted away from the can top, the nose end presses down on the can top next to the seam, initiating a break in the seam along the score line. The ring portion of the tab is then pulled up so as to extend the rupture of the seam along the score line until the can top is lifted sufficiently to allow access to the contents of the can, or completely separates from the can. A second type of pull-tab closure, typically found on beverage cans where liquid contents require only a small opening in the can top, differs from the first in that the score line circumscribes only a small removable section of the can top, which provides a smaller opening adequate for dispensing liquid contents. A variant of this latter class is the so called pop-top type of closure where a small section of the can top is ruptured away and pressed into the can interior upon lifting of the tab, allowing liquid contents to be dispensed.

Many persons have difficulty opening cans with pull-tab closures with unaided hands. Persons afflicted with conditions which impair their manual dexterity, such as limited hand/finger strength, arthritis or injury, may find it painful or actually impossible to open such containers. Individuals with large hands and thick fingertips may have difficulty grasping and lifting the thin, flat ring of the pull tab away from the can top. Those with long finger nails risk breaking their nails while opening such cans. Healthy people may strain joints in their hands by repeatedly opening this type of can over a period of time. A person may be at risk of being injured by the sharp edges of the can lid. Also, the tab may break-off if it is stressed beyond its design limits, thus preventing access to the cans contents.

While various devices have been conceived to assist in the opening of pull-tab cans, a continuing need exists for an opener which is truly easy to use by virtually anyone and is specially adapted for opening cans in the first class described above, where the entire can top must be torn away in order to gain access to the contents of the can.

SUMMARY OF THE INVENTION

The present invention addresses the aforementioned need by providing a hand tool for use in opening pull-tab type cans of the type having a raised rim about a can top and a planar ring riveted in a flat initial position to a top surface of the can top, the tab including a ring portion defining a finger opening on one side of the rivet and a nose on an opposite side of the rivet such that lifting of the ring portion presses the nose against the can top to start a break in a score line in the can top, so that thereafter the break may be extended circumferentially about the can top by pulling on the ring portion.

The opener tool according to this invention has a working end, a convexly curved underside portion and a handle fixed to the tool body. The working end is dimensioned for insertion under the ring portion of the pull tab, through the finger opening in the pull tab and over the can rim, all without lifting the pull tab ring sufficiently to break the seal of the can top along the score line. The tool further has a stop element for limiting insertion of the working end through the finger opening thereby to position the curved underside portion over the can top.

The curved underside may generally extend from 90 to about 180 degrees of arc. In a presently preferred form of the invention the curved underside extends about 180 degrees of arc and the working end extends tangentially at one end of the curved underside, and the handle connects the opposite ends of the curved underside. A slot or equivalent structure is provided on the working end for retaining the ring to the opener tool after the can top has fully separated from the can wall and thereby prevent the can top from springing away.

In alternate embodiments of the invention the tool body is a continuous strip of sheet material having a width greater than the width of the pull tab finger opening but narrower at the working end for admission into said finger opening. A transition to the narrower width of the working end may serve as the stop elements for limiting insertion of the working end through the finger opening. The flat strip may be bent at approximately a right angle along the curved portion, and the handle may be a portion of the strip continuous with the bent portion. Alternatively, the handle may be affixed to an intermediate location of the strip. In either case the handle extends upwardly of and transversely to an upper surface of the working end. Desirably, the working end has a beveled edge characterized by a bevel surface facing in the same direction as the curved undersurface to facilitate insertion of the working end through the ring portion of the pull tab.

A pull top can is opened using the opener tool of this invention by inserting the working end of the opener under the pull tab ring portion, through the finger opening and over the can rim without lifting the pull tab sufficiently to break the seal of the can top; leveraging the working end on the rim in one direction for lifting the ring portion sufficiently to start the break in the can seal along the score line; and then rocking the opener on the curved underside portion against the can top in an opposite direction, pulling up the ring portion together with the can top to extend the break along the score line sufficiently to gain access into the can.

The tool body is configured and dimensioned so that at least a portion of the curved undersurface rests on the can top inside the can rim while the working end is engaged in the pull tab ring against the stop, and as the opener is started through its rocking movement on its curved undersurface for extending the break in the score line. During the final part of the rocking motion just prior to full separation of the can top from the can wall, the curved underside rides up onto the can rim, such that the opener tool is supported on the rim before the can top separates completely from the can.

The tool body is elongated along a main dimension with the underside portion curved in the direction of the main dimension and contiguous with an undersurface of the working end. The convex underside is at least partially planar in a direction transverse to the main dimension for supporting the strip against wobbling in the transverse direction during rocking movement of the opener on the can top.

These and other features, improvements and advantages of the present invention will be better understood by reference to the following detailed description of the preferred embodiments taken in conjunction with the accompanying drawings, wherein similar numerals designate similar elements.

DETAILED DESCRIPTION OF THE PREFERRED EMBODIMENTS

Figure 1:
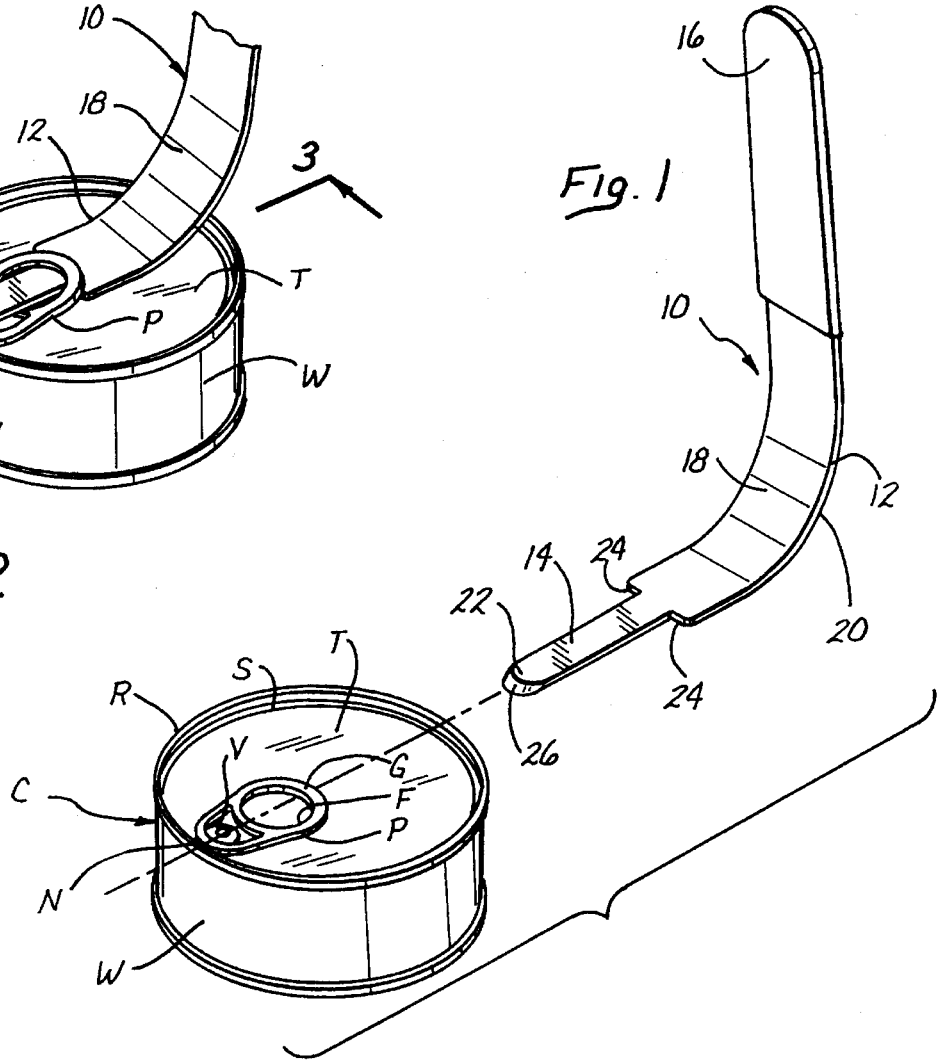
FIG. 1 is a perspective view of a basic form of the can opener according to this invention shown prior to engagement with a typical pull-tab can.

With reference to the drawings, FIG. 1 shows a hand tool 10 for use as an aid in opening pull-tab cans such as designated by the letter C in FIG. 1. The can C has a cylindrical can wall W, a can top T which is crimped onto the can wall to seal the contents of the can and forming a raised circular rim R. The seam between the can top T and the raised rim R is weakened by a circular score line S which circumscribes the can top T. A pull-tab P is riveted at V to the can top. The pull-tab has a ring portion G which defines a finger opening F, circular in the present example. Diametrically opposed to the ring portion G on the pull-tab is a rounded nose portion N. In FIG. 1 the pull-tab P is shown in its normal position in an original sealed condition of the can, wherein the pull-tab lies flat i.e. parallel to and only slightly spaced from the can top T. The rivet V serves as a fulcrum for the pull-tab. By lifting the ring portion G, the nose N is depressed against the can top close to the score line S, causing an initial, localized break in the seam line under the nose N. The ring portion G is then manually pulled upwardly to tear the can top T away from the rim R by extending the initial break along the length of the seam line S.

The opener 10 has a unitary tool body 12 which in this embodiment is an elongated strip of rigid sheet material, such as aluminum. The strip 12 has a working end 14, a handle end 16 and a bent intermediate section 18 which defines a convexly curved underside 20. The working end 14 is straight and flat, and has a width smaller than the interior diameter or width of the finger opening F in the pull-tab P. The working end 14 has a thickness which is small relative to its width. Specifically, the thickness of the working end 14 is such as to permit the tip 22 of the working end to pass under the ring portion G, through the finger opening F and then over and passed the raised rim R, to a position illustrated in FIG. 2, without lifting the pull-tab P sufficiently to break the seal of the seam S. A beveled edge 26 around the tip 22 has a bevel surface which faces upwardly, in the direction of the handle 16 and away from the can top T so as to facilitate insertion of the working end 14 underneath the ring portion G of the pull-tab. The remainder of the strip 12, along the curved intermediate section and the handle portion has a uniform width which is greater than the diameter or width of the finger opening F of the pull-tab P. The working end 14 is narrower than the width of the strip 12 so as to pass through the finger opening F. A transition between the narrow width of the working end 14 and the wider midsection of the strip 12 is defined by two short transverse shoulder edges 24 which serve as a stop for limiting passage of the working end 14 through the ring portion G of the pull-tab. The handle portion 16 may be dip coated with a rubber material for comfort and improved gripping of the opener 10.

Figure 2:
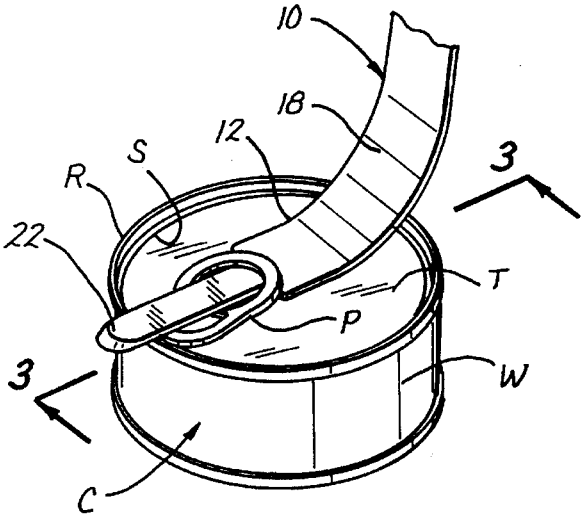
FIG. 2 shows the can opener of FIG. 1 engaged to the pull-tab of the can prior to lifting the pull-tab and breaking the seal of the can top.
Figure 3:
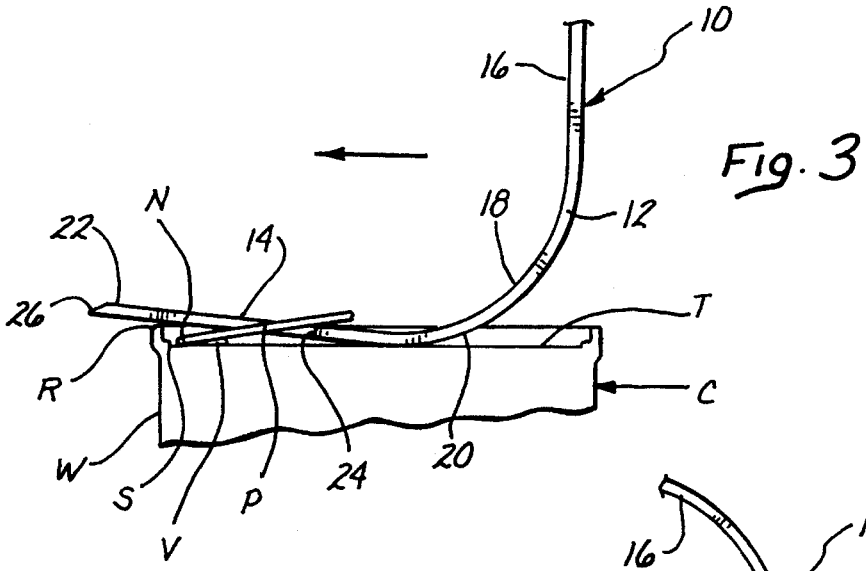
FIG. 3 is a side view partly in section along line 3—3 in FIG. 2, showing a first step in the can opening sequence where the can opener is engaged with the pull tab on the can top.
Figure 4:
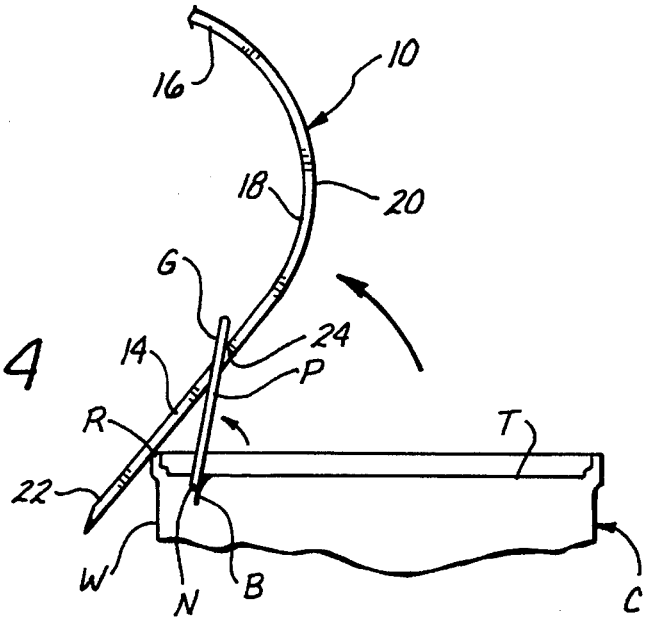
FIG. 4 is a side view as in FIG. 3 showing a second step in the can opening sequence wherein the can opener pivots against the rim of the can to lift the pull-tab and make an initial break between the can top and the rim.
Figure 5:
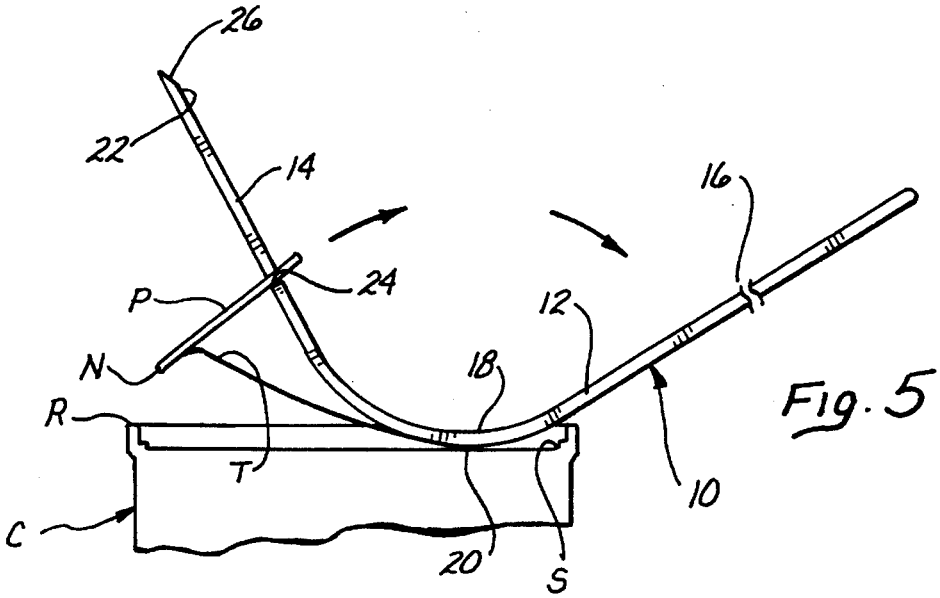
FIG. 5 is a side view as in FIG. 3 showing a third step in the can opening sequence wherein the can opener rocks backwards against the can top to extend the initial break along the circumference of the can top and lifts the can top away from the can.

FIGS. 2 and 3 show the opener 10 engaged to the pull-tab P in a first stage of the can opening sequence depicted in FIGS. 3, 4 and 5. The can C is held in one hand, preferably on a table top or other work surface, and the handle 16 of the opener 10 is grasped with the other hand. The length of the working end 14, measured between the tip 22 and the shoulders 24, is such that the tip 22 extends radially outwardly of the rim R when the working end 14 is engaged to the pull-tab P as shown in FIGS. 2 and 3. Furthermore, the dimensions of the opener 10 are such that the curved underside 20 is positioned over the can top T within the rim R after the tip 22 has been passed through the pull-tab P and over the rim R to the position shown in FIG. 2.

A second stage in the can opening sequence is illustrated in FIG. 4, where the opener 10 pivots in a counterclockwise direction with the rim R as a fulcrum, by lifting the handle 16 while the tip 22 swings down and towards the can wall W. The pivotal movement of the opener 10 lifts the ring portion G, depressing the nose N of the pull-tab and making an initial break B in the score line S. The manual force required to carry out this step is relatively small due to the leverage provided by the opener 10, which is a function of the distance between the handle 16 and rim R, providing a relatively long moment arm, as compared to the small moment arm originally provided by the pull-tab P due to the much smaller distance between the rivet V and the end of ring portion G. The task is further eased due to the fact that the force is applied with the full hand gripping the opener handle 16 as opposed to lifting the pull-tab P with the fingertips. The counterclockwise pivotal movement of the opener 10, while lifting the pull-tab to break the seal of the can, is self-limiting in that the working end 14 can only pivot to a generally vertical position against the outside of the can wall W, at which point further pivotal movement becomes very difficult, avoiding tearing of the pull tab from its rivet. In fact, increasing resistance offered by the pull-tab P will indicate that the objective of this stage in the can opening sequence has been completed before the limiting positioning of the tool 10 is reached.

A third stage in the can opening sequence using the opener 10 is shown in FIG. 5. In this stage, the opener 10 is pivoted in a clockwise position until the underside 20 rests on the can top T, while the working end 14 remains engaged with the now raised ring end G of pull-tab P, i.e. extending through the finger opening F. Manual force is then applied to pivot the opener 10 in a clockwise direction as indicated by the arrow in FIG. 5, by rolling the curved surface 20 against the can top T, while the pull-tab P is carried on the working end 14 against the shoulders 24. In this stage the opener 10 provides substantial leverage, determined by the length of the opener handle 16 in relation to the distance between the contact point with the can top and the engagement point with the pull-tab P. The clockwise rocking of the opener 10 upon the curved underside 20 pulls up the tab P and tears the can top T away from the rim R by extending the initial break B in FIG. 4 along the score line S until the can top T is lifted sufficiently for access to the contents of the can C. Just prior to complete separation of the can top from the can, the handle 16 can be urged sideways and leaned to either side, until it rests on one side edge on the rim R, so as to complete shearing away of the can top without it being placed into elastic tension. This maneuver greatly reduces the likelihood of the can top "springing" away and splattering can contents when the can top finally separates from the can wall W.

The midsection 18 of the strip is curved through a little over 90 degrees of arc along the main dimension of the strip which runs from the tip 22 to the end of the handle 16. However, the curved underside 20 is planar in a direction transverse to the main dimension of the strip, in order to provide stability and keep the opener 10 from twisting or wobbling sideways while rocking against the can top during the third phase of the can opening sequence.

The handle 16 extends upwardly from the can top when the opener 10 is initially engaged with the pull-tab P, as in FIG. 3, so that in the third stage of the sequence, as in FIG. 5, the handle 16 remains above the can C as it is pivoted downwardly to pull up the can top T. This prevents the handle end from striking the table top on which the can will be normally supported, which would immobilize the opener 10 and prevent lifting of the can top, as would be the case if a completely straight opening tool were used in the sequence of FIGS. 3 through 5.

It is contemplated that an opener 10 can be included in every case of canned goods, for example, cases shipped to institutional purchasers, such as commercial kitchens and the like. For this purpose, it is advantageous to bend the strip 12 so that the radius of curvature of the midsection 18 equals the radius of curvature of the can wall W. The opener 10 can then be easily fitted in a corner of a carton or case by placing the concave upper surface of the curved portion 18 around a can in any of the four corners of the carton, with the straight working end 14 and handle 16 extending along the side walls intersecting at the particular corner. The thin strip 12 can be easily fitted edgewise between the cans and the side walls of the carton in this manner, and will remain securely in place during shipment and handling of the carton.

Pop-top cans are made in a considerable range of sizes, from single serving containers to large, institutional size cans, although the size of the pull-tab and ring sections R usually remains the same for the various can sizes. The dimensions of the opener 10 should generally take into account the size of the cans to be opened. While the overall dimensions are not critical, the length of the working section 14 between the tip 22 and the middle of the curved underside 20 should approximately equal the diameter of the rim R. If this dimension is much smaller than the ring diameter, it will be found that it becomes difficult to lift up the can top T sufficiently in the third stage of the sequence illustrated in FIG. 5. Conversely, if this dimension is much greater than the ring diameter, it will not be possible to position any part of the curved underside 20 against the can top while engaged to the pull tab P, and the opener will instead rest on the rim R at diametrically opposed points of the can top. While the opener 10 can possibly be used even then, it is not the preferred usage of the device as the opening procedure becomes more difficult.

Figure 6:
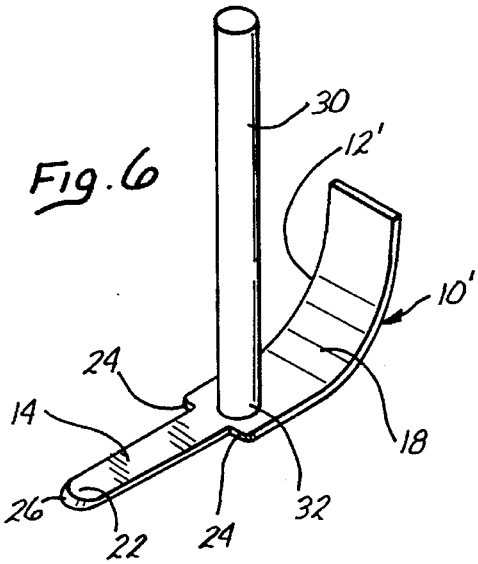
FIG. 6 is a perspective view of a first alternate form of the can opener of this invention.

FIG. 6 shows an alternate embodiment 10' of the opener according to this invention, which differs from the earlier described opener 10 in that the handle is a rod 30 which is fixed at a lower end 32 to the upper surface of the strip 12 just rearwardly of the stop shoulders 24. The strip 12' in FIG. 6 is thus shorter by elimination of the handle portion 16 of the previously described embodiment. In other respects and in its usage the opener 10' is similar and equivalent to the opener 10 of FIGS. 1 through 5.

Figure 8:
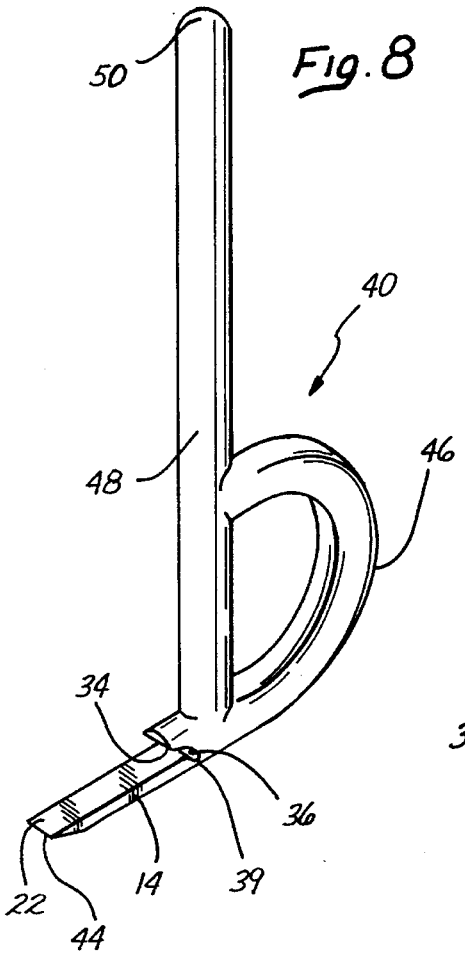
FIG. 8 shows a presently preferred form of the can opener of this invention.
Figure 8A:
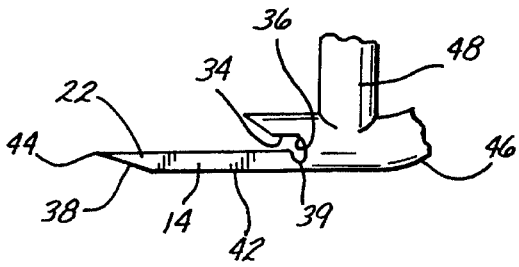
FIG. 8*a* is a detail view in side elevation of the working end of the opener of FIG. 8 showing the stop and end groove at the inner end of the working tip.
Figure 9:
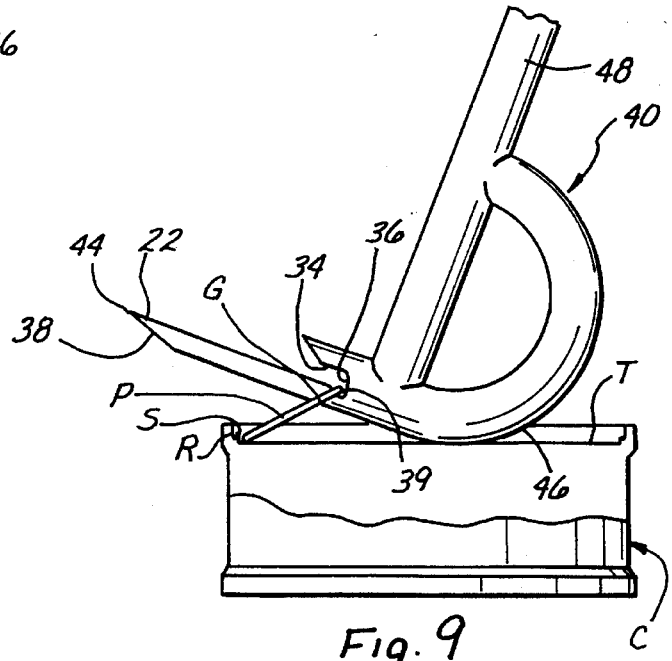
FIG. 9 is a side elevational view showing the opener of FIG. 8 engaged to a pull tab after the break in the score line S has been initiated and the opener is in the initial portion of clockwise rolling on its curved undersurface for lifting the can top T.
Figure 10:
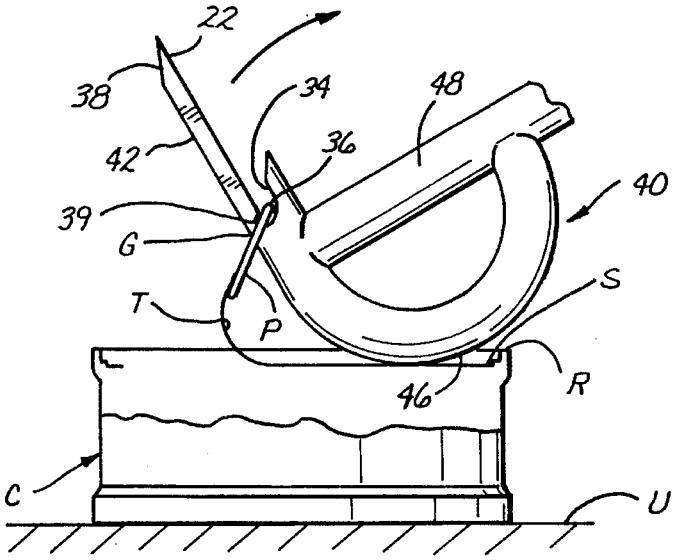
FIG. 10 is a view as in FIG. 9 showing the opener in a more advanced stage of clockwise rolling movement with the can top partially lifted away from the can.

FIGS. 8 through 10 show a presently preferred form of the can opener of this invention, designated by numeral 40, where a retaining slot 34 for receiving the ring G of the pull tab is defined between the upper surface of the working end 14 and stop element 36. The retaining slot 34 includes an end groove 39 for capturing and holding the pull tab ring G during the third stage of the can opening sequence as illustrated in FIG. 10. This feature prevents the can top T from springing away from the opener 40 and the can C as soon as the can top has been fully separated from the can. This has a tendency to occur because the can top is of thin sheet metal with considerable resilience, and the can top is flexed by the opener during the third stage of the opening sequence. As the last of the score line S connecting the can top to the rim R is torn, the can top may spring away under the force being applied through the opener. The slot 34 and groove 36 engage the ring G and hold the can top T to the opener 40 after the can top has been fully separated from the rim, and also minimizes splatter of any can contents adhering to the underside of the can top.

The bevel surface 38 at the tip 22 of the working end 14 faces the undersurface 42 of the working end. This orientation is presently preferred in that it assists the tip 22 in overriding the inside edge of the ring G as the tip moves through the finger opening and towards the can rim R. The bevel 38 also provides a relatively sharp leading edge 44 which facilitates initial insertion of the tip 22 under the outer edge of the ring G, by tilting forward the opener 40 so as to bring the bevel surface 38 flush against the can top T until the tip 22 slides under the ring G and into the finger opening F.

The convexly curved underside 46 is extended through a full 180 degree semicircle in this embodiment, as compared to the much smaller curvature of about 90 degrees shown for the undersurface 20 in the embodiment 10 of FIGS. 1–5 . The extended curvature allows the opener 40 to function with a wider range of can sizes. The long curved surface 46 increases the diameter of the can top which can be covered by the opener 40 as it rolls on the underside 46 against the can top T in the third stage of the can opening sequence illustrated in FIG. 10, and consequently reduces the number of differently sized openers needed to cover the full range of pull tab can sizes in common use. In the opener 40 the handle 48 is offset radially inwardly on the can top T during rolling of the opener 40 as the can top is lifted away from the can wall, as in FIG. 3, which allows a greater range of downward pivotal movement of the handle 48 before the handle end 50 strikes a supporting surface underlying the can C, such as a tabletop U in FIG. 10.

The full semicircle defined by the rolling undersurface 46 connects with the handle 48 at two spaced apart locations to support and reinforce the handle 48, increasing the overall stiffness of the opener 40 so that lighter materials can be used for its manufacture. For example, the opener 40 can be made of injection molded thermoplastic with a hollow handle interior, open at the lower end of the handle, for light weight.

Figure 11:
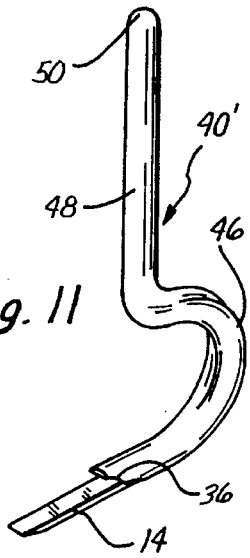
FIG. 11 a perspective view of a variant of the opener of FIG. 8.

FIG. 11 shows an opener 40' which is a variation of the opener 40 of FIGS. 8–10 and differs therefrom only in that the handle terminates at the top end of the curved intermediate portion 46 opposite to the working end 14, so that the two ends of the semicircular portion 46 are no longer connected by the handle. The use and operation of the two openers 40 and 40' is similar.

Common to all three embodiments 10, 10' and 40 of the disclosed opener is a working end 14 shaped for insertion under the ring G of the pull tab P, a positive stop (24 or 36) for limiting insertion of the working end through the ring; the working end 14 being of sufficient length to extend over the rim R of the can while fully inserted through the ring against its stop element 24, 36; a curved undersurface 20, 46, preferably planar in a transverse direction, and configured to at least partially overlie the can top T with the working end 14 engaged to the ring G in its limiting position against the stop 24, 36; and an upwardly extending handle 16, 30, 48, all cooperating in the operation of the opener of this invention.

Figure 7:
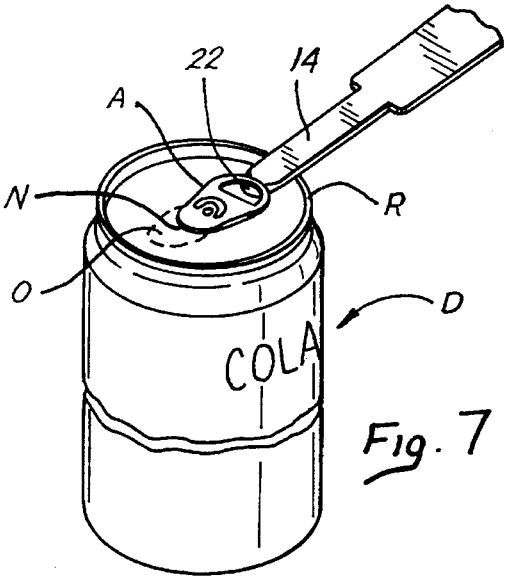
FIG. 7 illustrates the use of the can opener of this invention for opening a pop-top beverage can.

FIG. 7 illustrates the use of the opener in any of its described embodiments, for opening a pop-top type beverage can D with a tab A. The tip 22 of working end 14 is inserted under the tab A while supported on the rim R, and the opener then pivoted outwardly and downwardly on the rim so as to lift the tip 22, thereby depressing the opposite end N of the tab A to open the closure O of the can. While the opener 10 or 10' is specifically intended for opening pull-tab cans such as shown in FIGS. 1 through 5, it is versatile enough to also assist in the opening of pop-top beverage cans as shown in FIG. 7.

While certain preferred embodiments of the invention have been described and illustrated for purposes of clarity and example, it must be understood that many changes, substitutions, and modifications to the described embodiments will become obvious to those possessed of ordinary skill in the art without thereby departing from the scope and spirit of the present invention which is defined by the following claims.

What is claimed is:

1. A hand tool for use in opening pull-tab type cans, the cans having a raised rim about a can top and a planar tab attached by a rivet in a flat initial position to said can top, the tab including a ring portion defining a finger opening on one side of the rivet and a nose on an opposite side of the rivet such that lifting of the ring portion presses the nose against the can top to start a break in a score line circumferentially encompassing the can top including said tab, so that the break may then be extended circumferentially about the can top by pulling on the ring portion, said hand tool comprising:

a tool body having an elongated working end connected to one end of a middle portion having a convexly curved underside and a handle fixed to said middle portion, said working end being dimensioned to pass under said ring portion, through said finger opening and into contact with said rim while at least part of said curved underside remains positioned over said can top within the rim of the can, such that said rim provides a first fulcrum point for pivotal movement of said working end towards said tab for lifting the ring portion to break the score line, and the tool body may then be rolled on said curved underside as a second fulcrum point against said can top in the opposite direction away from said tab to pull up on the ring portion for extending the break along the score line while lifting the can top away from the can, said curved underside having a relatively large radius of curvature so as to result in substantial translation of said second fulcrum point across said can top away from a starting point generally adjacent to said tab towards said rim and away from said tab while lifting said can top.

2. The hand tool of clam 1 wherein said curved underside extends about 180 degrees of arc.

3. The hand tool of claim 1 wherein said curved underside extends about 90 degrees of arc.

4. The hand tool of claim 1 further comprising a stop for limiting insertion of said working end through said finger opening thereby to position said curved underside on said can top with said working end extending over and beyond said rim, and to prevent further insertion of said working end through said ring portion during said pivotal movement of said working end towards said tab.

5. The hand tool of claim 1 wherein said working end is generally straight, and said handle is generally perpendicular to said working end.

6. The hand tool of claim 1 wherein said middle portion forms a 180 degree arc, said working end extends tangentially from one end thereof and said handle is attached radially to an opposite end thereof.

7. The hand tool of claim 1 wherein said working end has a beveled edge to facilitate its insertion between said ring portion and said can top.

8. The hand tool of claim 1 wherein said curved underside has a radius configured and dimensioned to move said tool body onto said rim at a point approximately diametrically opposed to said first fulcrum point when said hand tool is rolled on said curved undersurface in said opposite direction while engaged in said ring portion for extending said break, such that said tool body is supported on said rim before said can top separates completely from said can.

9. A hand tool for use in opening pull-tab type cans of the type having a raised rim about a can top and a planar tab attached by a rivet in a flat initial position to said can top, the tab including a ring portion defining a finger opening on a one side of the rivet and a nose on a an opposite side of the rivet such that lifting of the ring portion presses the nose against the can top to start a break in a score line circumferentially encompassing the can top including said tab, and so that the break may then be extended along the score line about the can top by pulling on the ring portion, said hand tool comprising:

a tool body having a middle portion with a convexly curved underside, an elongated working end extending from said middle portion at one end of said curved underside, and a handle connected to said middle portion, said working end being dimensioned to pass under said ring portion, through said finger opening and over said rim, said working end terminating at stop means dimensioned for limiting insertion of said working end through said ring for positioning at least part of said curved underside over the can top with said stop means engaged against said ring portion, such that said working end can be pivoted in one direction against said rim as a first fulcrum for leverage in lifting said ring portion from said flat initial position to start a break in the score line, and said tool body may then be rolled in the opposite direction on said curved underside portion against the can top as a second fulcrum for pulling up on the ring portion to extend the break along the score line thereby to separate the can top from the can; said curved undersurface having a sufficiently large radius such that said second fulcrum moves onto said rim from an initial position generally adjacent to said ring portion on said can top when said hand tool is rolled on said curved underside in said opposite direction while engaged in said ring portion for extending said break, such that said tool body is supported on said rim before said can top separates completely from said cab.

10. The hand tool of claim 9 wherein said underside has a sufficient width to provide stability against sideways wobbling of the tool body during rolling on said can top.

11. The hand tool of claim 10 wherein said stop means is defined by a transition in width between said working end and a greater width of said underside.

12. The hand tool of claim 10 wherein said working end has a substantially planar underside continuous with said curved underside.

13. A method for opening pull-tab type cans, the cans having a can top joined to a cylindrical can wall along a raised rim and a pull tab riveted in a flat initial position to the can top, the tab including a ring portion defining a finger opening on one side of the rivet and a nose on an opposite side of the rivet such that lifting of the ring portion presses the nose against the can top to start a break in a score line cut into the can top, so that the break may then be extended along the score line about the can top by pulling on said tab, comprising the steps of:

providing a hand tool characterized by a tool body having a working end, a convexly curved underside portion and a handle;

inserting said working end under said ring portion, through said finger opening and onto said rim;

leveraging said working end with said rim as a first fulcrum in one direction for lifting the ring portion sufficiently to break the score line; and then, without removing said working end from said ring portion, rolling said underside portion on said can top as a second fulcrum in an opposite direction such that said second fulcrum moves across said can top away from said tab to pull up the ring portion with the can top to extend the break along the score line sufficiently to gain access into the can.

14. The method of claim 13 further comprising the step of leaning the handle to the side so that the curved underside portion rests on only one side edge thereby to complete a break along said score line and completely separate the can top from the can wall thereby diminishing tensioning of the can top such as would cause the can top to spring away and splatter can contents upon full separation from the can wall.

* * * * *